US009694481B2

(12) United States Patent
Hayes, Jr.

(10) Patent No.: US 9,694,481 B2
(45) Date of Patent: Jul. 4, 2017

(54) TORQUE LIMITING WRENCH FOR PLASTIC AND OTHER FITTINGS

(71) Applicant: Fit-Line, Inc., Santa Ana, CA (US)

(72) Inventor: Frank F. Hayes, Jr., Costa Mesa, CA (US)

(73) Assignee: Fit-Line, Inc., Santa Ana, CA (US)

( * ) Notice: Subject to any disclaimer, the term of this patent is extended or adjusted under 35 U.S.C. 154(b) by 262 days.

(21) Appl. No.: 14/488,110

(22) Filed: Sep. 16, 2014

(65) Prior Publication Data

US 2016/0075005 A1 Mar. 17, 2016

(51) Int. Cl.
*B25B 23/142* (2006.01)
*B25B 13/08* (2006.01)
*B25B 13/50* (2006.01)

(52) U.S. Cl.
CPC ..... *B25B 23/142* (2013.01); *B25B 13/50* (2013.01)

(58) Field of Classification Search
CPC ..... B25B 23/142; B25B 13/08; B25B 13/50
USPC ..... 81/478
See application file for complete search history.

(56) References Cited

U.S. PATENT DOCUMENTS 455,606 A * 7/1891 Byrne ..... B25B 13/48 81/176.1
1,707,856 A * 4/1929 Hoffman ..... B25B 13/48 81/176.3
1,752,074 A * 3/1930 Gagne ..... B25B 13/02 81/119
2,826,107 A 3/1958 Woods
3,003,379 A * 10/1961 Pribitzer ..... B25B 13/02 411/427
3,137,187 A 6/1964 Van Hoose
3,202,021 A 8/1965 Livermont
3,670,602 A 6/1972 Van Hoose
5,152,200 A * 10/1992 Kaplan ..... B25B 23/1427 81/467
6,269,715 B1 * 8/2001 Cagny ..... B25B 13/46 81/119
6,295,901 B1 * 10/2001 Mardirossian ..... B25B 13/48 81/119
6,412,371 B1 * 7/2002 Storm ..... B25B 13/48 81/176.3

(Continued)

OTHER PUBLICATIONS

Entegris, Flare Fitting Assembly Aids, Entegris, 2000-2014.

(Continued)

*Primary Examiner* — Hadi Shakeri
(74) *Attorney, Agent, or Firm* — Larry K. Roberts

(57) ABSTRACT

A torque limiting wrench for tightening nuts on a fitting, and a jaw structure for the wrench. An exemplary embodiment of the wrench includes a handle structure, the jaw structure pivotably mounted to the handle for movement between a tightening position and a fully tightened position. A mechanism applies a force to hold the jaw structure in the tightening position, and allows the jaw to pivot to the fully tightened position when a pre-set torque limit is exceed. The jaw structure including a plurality of spaced teeth supported on a curved jaw arm and having a circumferential extent of less than one half the entire circumference of the nut to be tightened, so that the jaw structure can be engaged to the nut without requiring an axial movement from a first end of the nut toward a second end of the nut.

19 Claims, 11 Drawing Sheets

(56) References Cited

U.S. PATENT DOCUMENTS

| | | | | |
|---|---|---|---|---|
| 6,868,761 | B2 * | 3/2005 | Stoick | B25B 13/50 81/120 |
| 7,806,027 | B1 | 10/2010 | Gao | |
| 8,372,235 | B2 | 2/2013 | Hayes, Jr. | |
| 9,186,780 | B2 * | 11/2015 | Dumaine | B25B 13/50 |
| 2004/0003686 | A1 * | 1/2004 | Cagny | B25B 13/46 81/186 |

OTHER PUBLICATIONS

MMTB, Miniature Break-Over Wrench with Fixed Heads, 2012.
Parker Hannifin Corporation, Partek PFA Fittings Catalog 4181/USA, Dec. 2005.
Pasternack Enterprises, Inc., Pasternack the Engineer's RF Source, Break-Over Torque Wrench with 1/4 Bit for SSMA Connectors Preset to 8.1 in-lbs, undated.
TB Break-Over Wrench with Fixed Heads, undated.

* cited by examiner

FIG. 5C
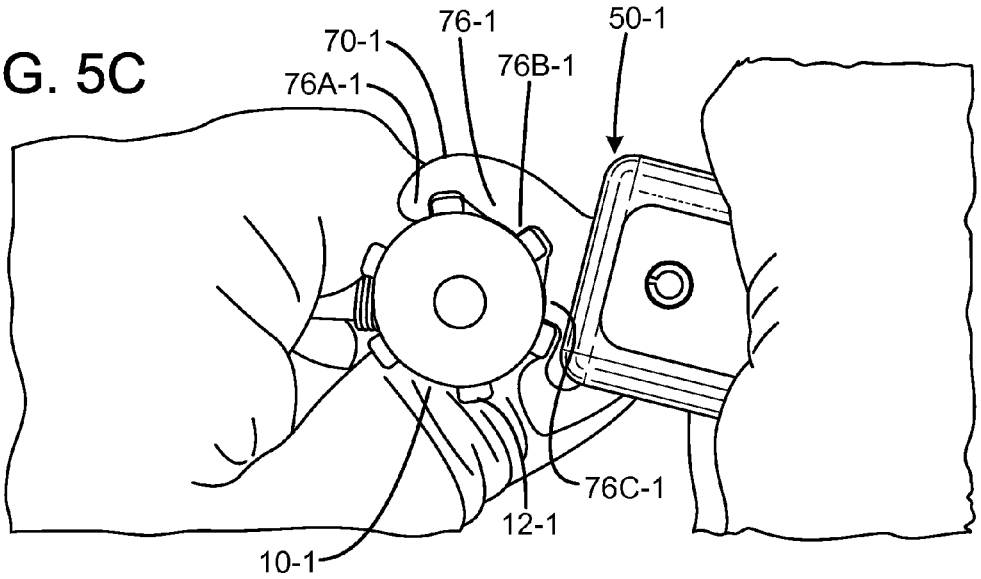
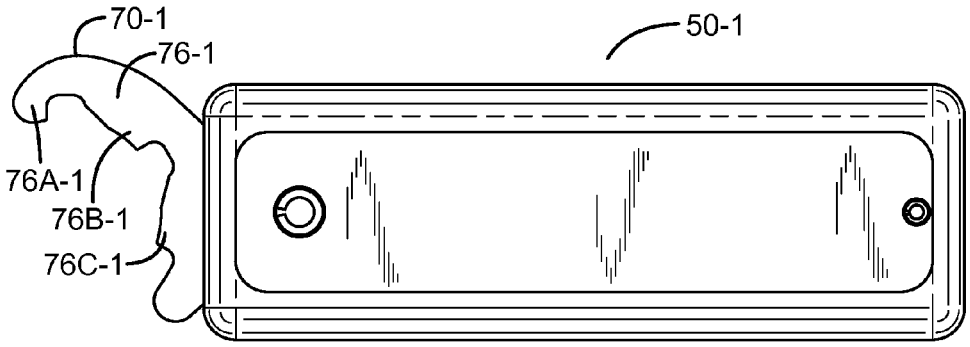
FIG. 6A
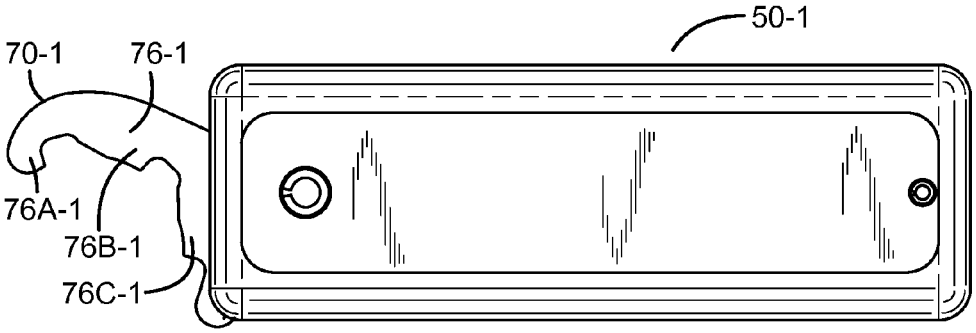
FIG. 6B

TORQUE LIMITING WRENCH FOR PLASTIC AND OTHER FITTINGS

BACKGROUND

Flexible and rigid tubing may have formed ends for use in coupling the tube to a fitting or to another tube. Flexible tubing may, for example, have flared ends to be joined to a flexible or rigid tube or fitting. A flared tube may be joined with a bushing and/or a nut, to connect to the tube or fitting. The inner diameter of the flare may be sized to accept and be joined to the outer diameter of a tube or fitting. The end of rigid tubing may be formed into a flare or flange. U.S. Pat. No. 7,604,472 B2, hereinafter the '472 patent, describes a method and apparatus for forming flared tube ends, the entire contents of which are incorporated herein by this reference.

Various types of plastic pipe and tube assemblies may be employed in fluid flow applications. The assemblies may for example be manifold assemblies, with an input port connecting to several output ports. Each of the ports may have tube or pipe fittings to allow the ports to be connected in a fluid system. The assemblies can have many ports, and reduction in footprint or size of the assemblies is desirable. U.S. Pat. No. 8,372,235, the entire contents of which are incorporated herein by this reference, illustrates exemplary assemblies of plastic parts. Exemplary fluid flow applications include those in the pharmaceutical and semiconductor fabrication industries, where different fluids are passed through complex fluid flow paths. Minimizing leaks in such fluid flow applications and installations can be a problem. The use of systems as describe in the '472 patent to form flared tube ends of high quality and dimensional stability has significantly addressed the problem of leaks in fluid flow applications utilizing flared tubing and associated fittings. However, the use of closely packed fittings in installations increases the difficulty of accessing the individual fittings to tighten connections, and thus presenting a risk of leakage.

BRIEF DESCRIPTION OF THE DRAWINGS

Features and advantages of the disclosure will readily be appreciated by persons skilled in the art from the following detailed description when read in conjunction with the drawing wherein:

FIG. 2A shows the wrench head in a tightening position relative to the handle, and FIG. 2B shows the position of the wrench head after a pre-set torque value has been reached, to ensure consistent tightening of nuts.

FIGS. 5A-5C diagrammatically illustrate a torque wrench in use on a plastic nut, showing initial engagement, the ratchet-like operation of the wrench on the nut and the wrench head in the tightened position after the pre-set torque has been applied.

FIGS. 6A-6*b* show the torque wrench with the jaw in two different positions, one in which the jaw is positioned to tighten a nut, the other in the position achieved after the pre-set torque has been applied.

DETAILED DESCRIPTION

Figure 1:
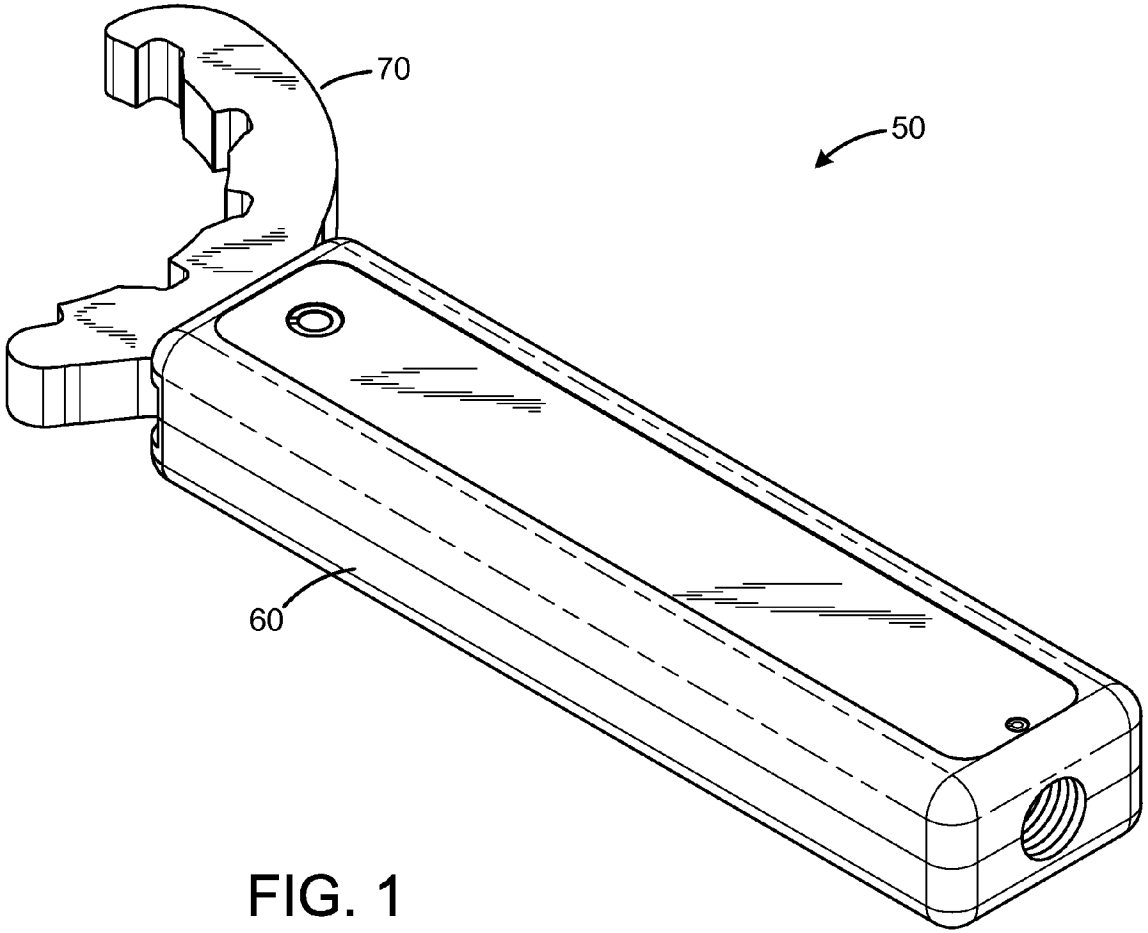
FIG. 1 is an isometric view of an exemplary embodiment of a torque limiting wrench configured to tighten nuts for fluid path fittings.

In the following detailed description and in the several figures of the drawing, like elements are identified with like reference numerals. The figures may not be to scale, and relative feature sizes may be exaggerated for illustrative purposes.

FIGS. 1-3B illustrate an exemplary embodiment of a torque limiting wrench configured to apply pre-calibrated amounts of torque by a wrench jaw to a nut threaded onto a fitting, before the jaw "breaks" or rotates on a pivot pin. In this embodiment, the wrench 50 includes a handle 60 and a wrench jaw 70. In an exemplary embodiment, the wrench jaw is configured to engage the nut by movement to the nut in a direction transverse to the nut axis. In other words, the wrench jaw is not required to be brought into engagement with the nut by an axially directed movement from one end of the nut toward the opposite end. This provides greater freedom in using the wrench in tight places The torque wrench 50 includes a handle 60 and the wrench jaw 70. In this embodiment, the handle is a one-piece unitary structure, fabricated from a metal such as aluminum, die cast zinc, or other rigid material such as a thermoplastic. Exemplary materials for fabrication of the jaw include stainless steel and steel. In other embodiments, the handle may be multi-piece, with removable side covers, for example. The handle has an open channel or recess formed in a first end 60A, to receive tongue portion 72 of the jaw 70. The jaw pivots on a pivot connection formed by roll pin 66A inserted in through hole 68 in the handle and hole 74 formed in the jaw 70 between a tip of the tongue portion 72 and the jaw portion 76. The channel end or bottom 64A has a wider extent than the channel opening at 60A, with the channel opening defining jaw travel stop surfaces 64B1 and 64B2 at opening 64B. The stop surface 64A1 is configured to stop clockwise (in the sense of FIG. 2A for example) movement of the jaw about the pivot pin 66A at a position for tightening a nut in engagement with the jaw. The stop surface 64A2 is configured to stop counterclockwise movement (in the sense of FIG. 2B) of the jaw 70 about the pin 66A after the jaw has exceeded the pre-set torque and rotated in the counterclockwise direction.

Figure 2A:
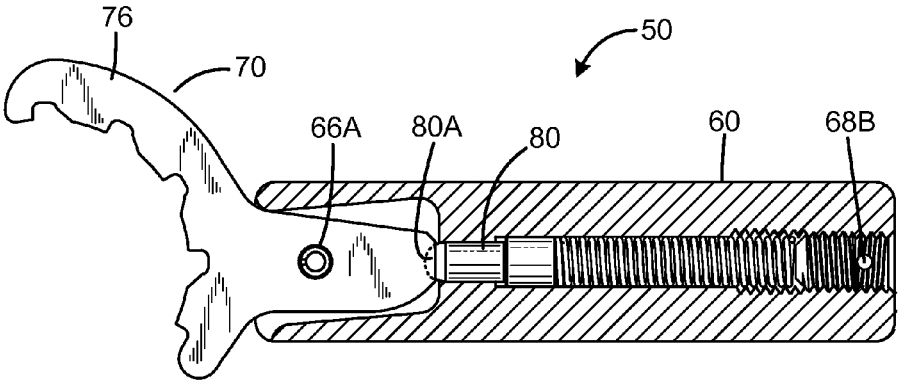
FIGS. 2A and 2B are diagrammatic front views of the torque wrench of FIG. 1, cut away to show the internal components.
Figure 2B:
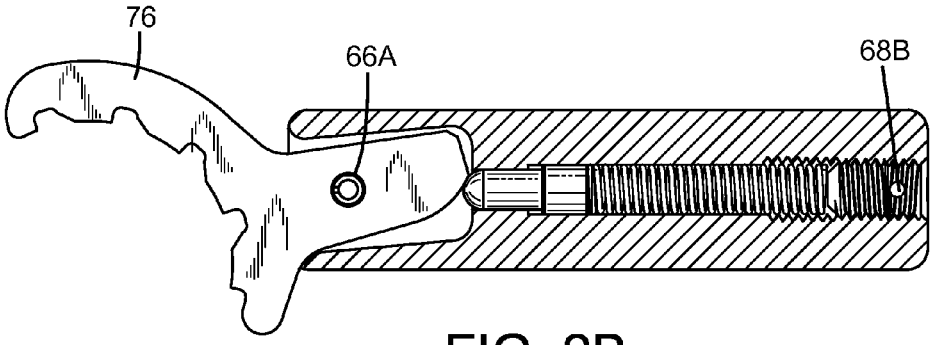

The torque limiting wrench 50 includes a mechanism to hold the jaw in the tightening position (FIG. 2A) until the amount of torque applied to the pivot connection between the jaw and handle exceeds a pre-determined limit, and then allows the jaws to pivot on the pin 66A to the fully tightened position (FIG. 2B). The mechanism in this exemplary embodiment includes a sliding post 80 fitted for sliding movement within an open bore 62 in the handle and that engages a surface of the jaw 70, a bias element 82 and an adjustment element 84. Thus, in this exemplary embodiment, the channel 64 communicates with open bore 62 formed within the handle; the bore 62 is in alignment with the longitudinal axis of the handle. The post 80 is fitted into the open bore 62 and is biased in position toward the jaw end of the handle by spring 82 and set screw 84. The set screw engages the threads in threaded portion 62D, and by advancing or retracting the set screw against the spring, the spring force pushing the post 80 toward the jaw end of the handle can be increased or decreased. This set screw provides an adjustment of the pre-set torque for the torque limiting wrench, and the position of the set screw may be locked after a calibration or adjustment, by insertion of roll pin 66B in hole 68B in the handle 60. The wrench may be calibrated to set the torque limit to a particular desired torque limit, by use of a torque tester. Suitable torque testers are available commercially, e.g. the tester series TT02, marketed by Electromatic Equipment Co., Inc., Cederhurst, N.Y.

Figure 3A:
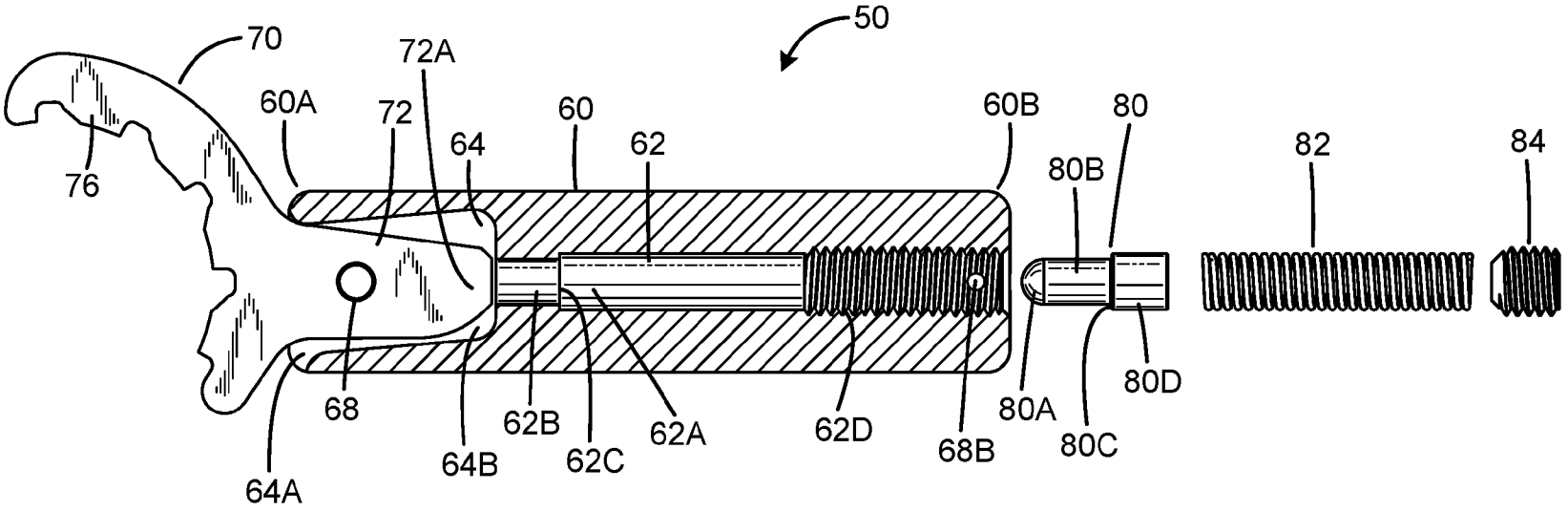
FIG. 3A is an exploded, partially broken away diagrammatic front view of the torque wrench of FIG. 1.
Figure 3B:
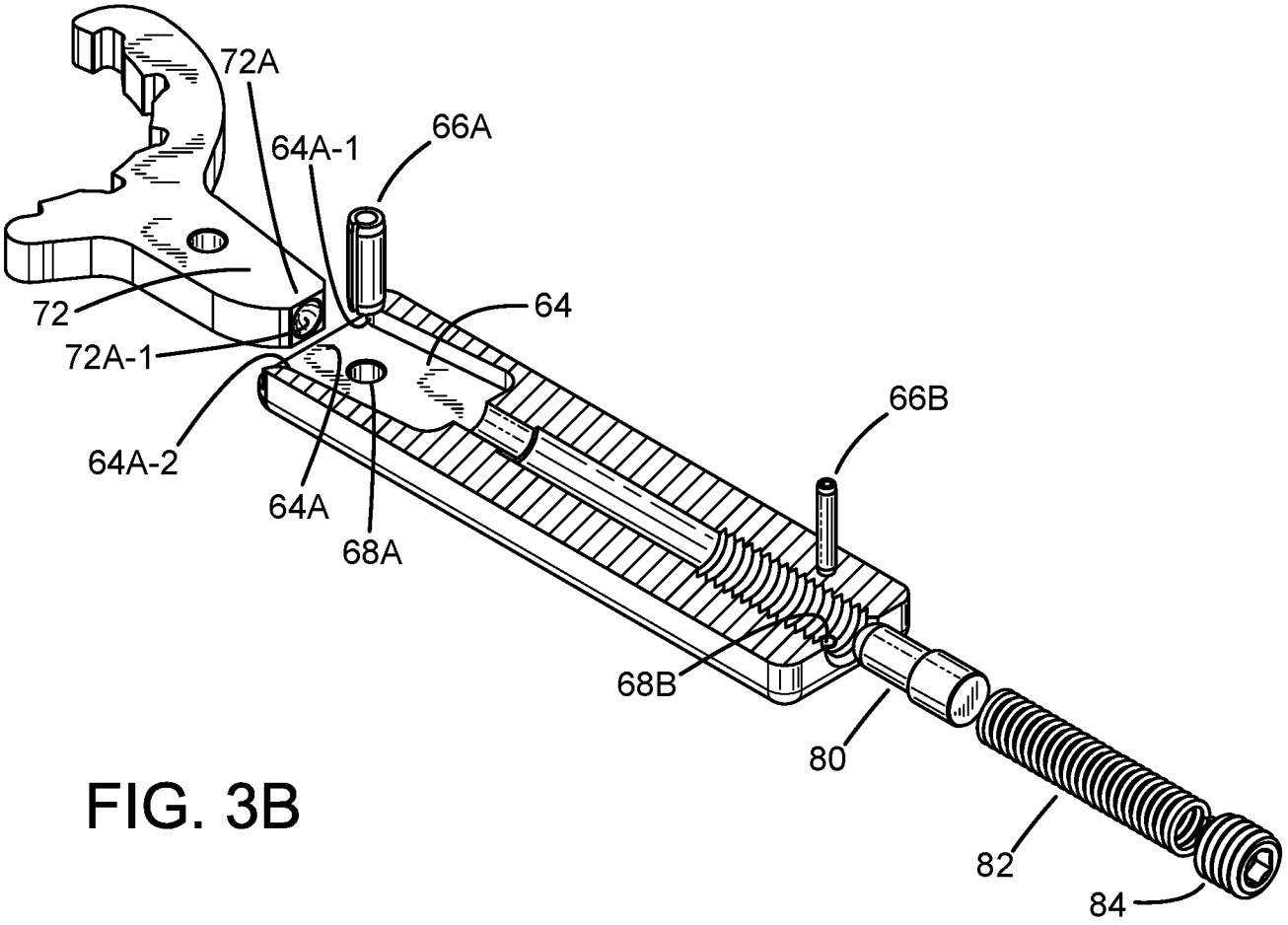
FIG. 3B is an exploded, partially broken away diagrammatic isometric view of the torque wrench of FIG. 1.

The jaw 70 includes a tongue portion 72 extending from jaw arm portion 76. The tip portion 72A of the tongue 72 has a detent or dimple 72A-1 formed therein (FIGS. 2A, 3B). The end 80A of post 80 is received into the detent with the jaw 70 in the tightening position (FIG. 2A). The post may be fabricated of heat treated stainless steel, in an exemplary embodiment. The bore 60 in this embodiment has a reduced diameter portion 62B adjacent the channel 64, smaller in diameter than bore portion 62A, with a step shoulder 62C at the transition from the portions 62A, 62B. The post 80 has a rounded, semispherical or ball shaped head portion 80A, an intermediate cylindrical portion 80 and an end cylindrical portion 80D of larger diameter than that of portion 80B, creating a step shoulder 80C. The corresponding shoulders 62C, 80C prevent the post 80 from further axial movement toward the jaw after the shoulders are brought into contact. This serves to hold the post from being pushed out from the bore into the channel 64 before the jaw is installed, and also limits the maximum torque setting for the wrench.

Figure 4A:
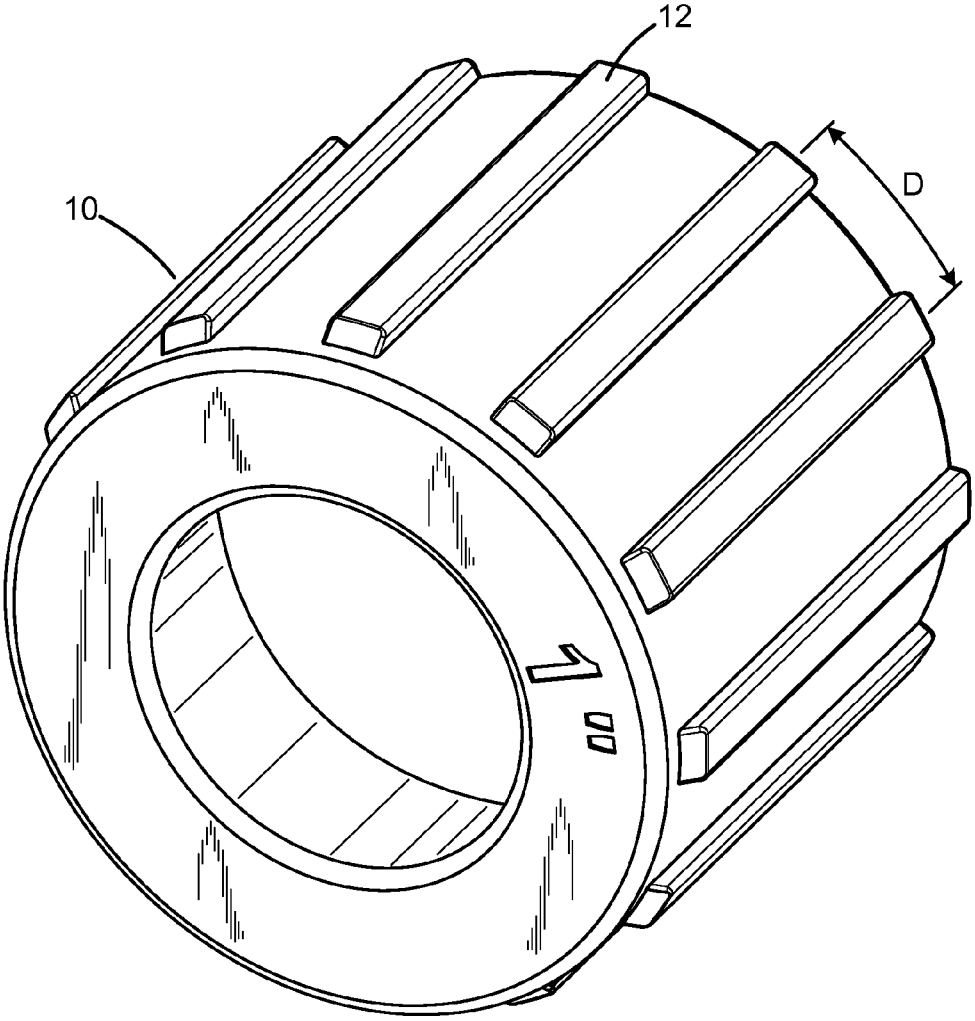
FIG. 4A is an isometric view of an exemplary plastic nut for a flared plastic fluid fitting, illustrating an exemplary external spline pattern.
Figure 4B:
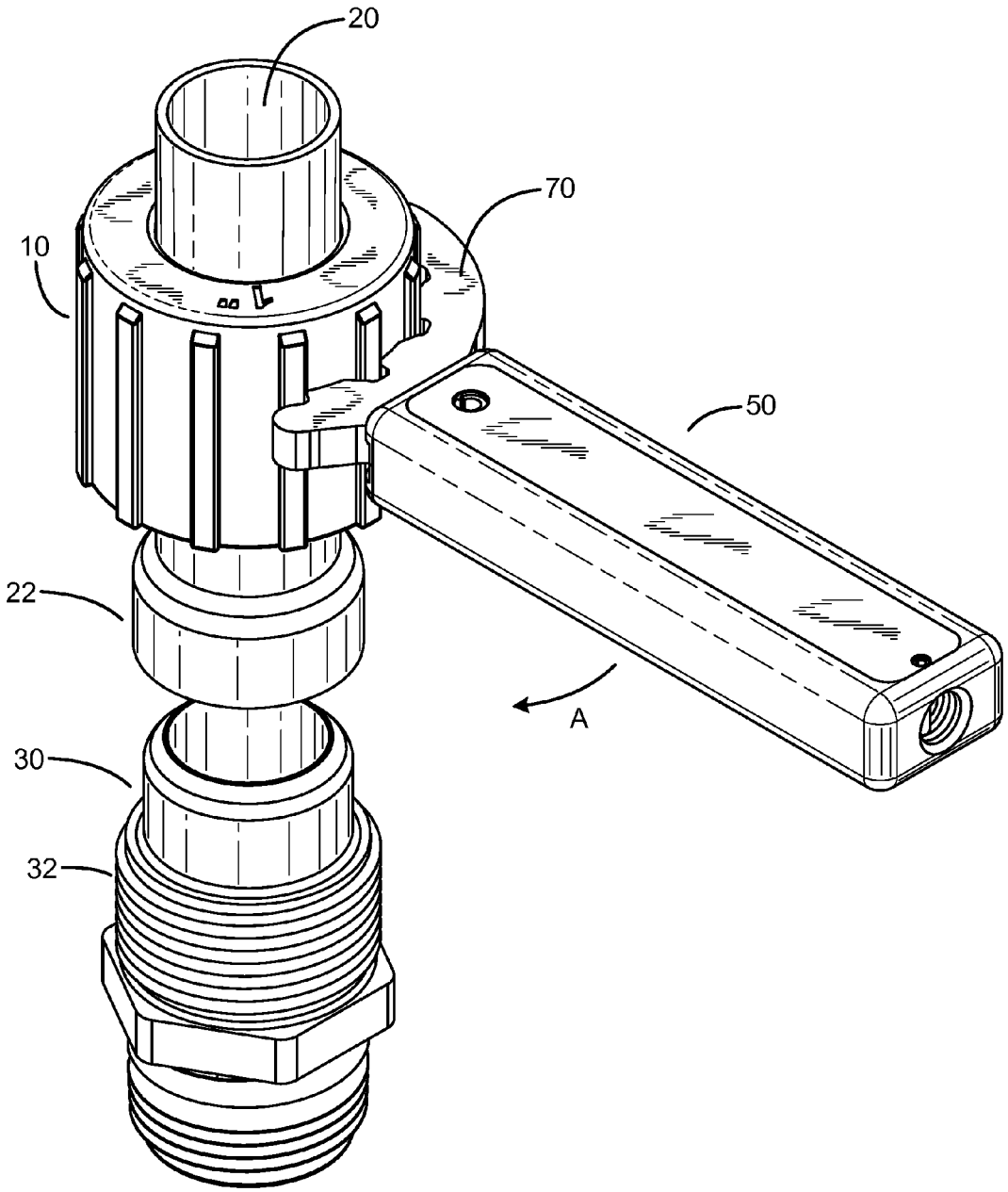
FIG. 4B is an isometric view illustrating the nut, flared tube and fitting, with an exemplary torque wrench engaging the nut and its splines.
Figure 4C:
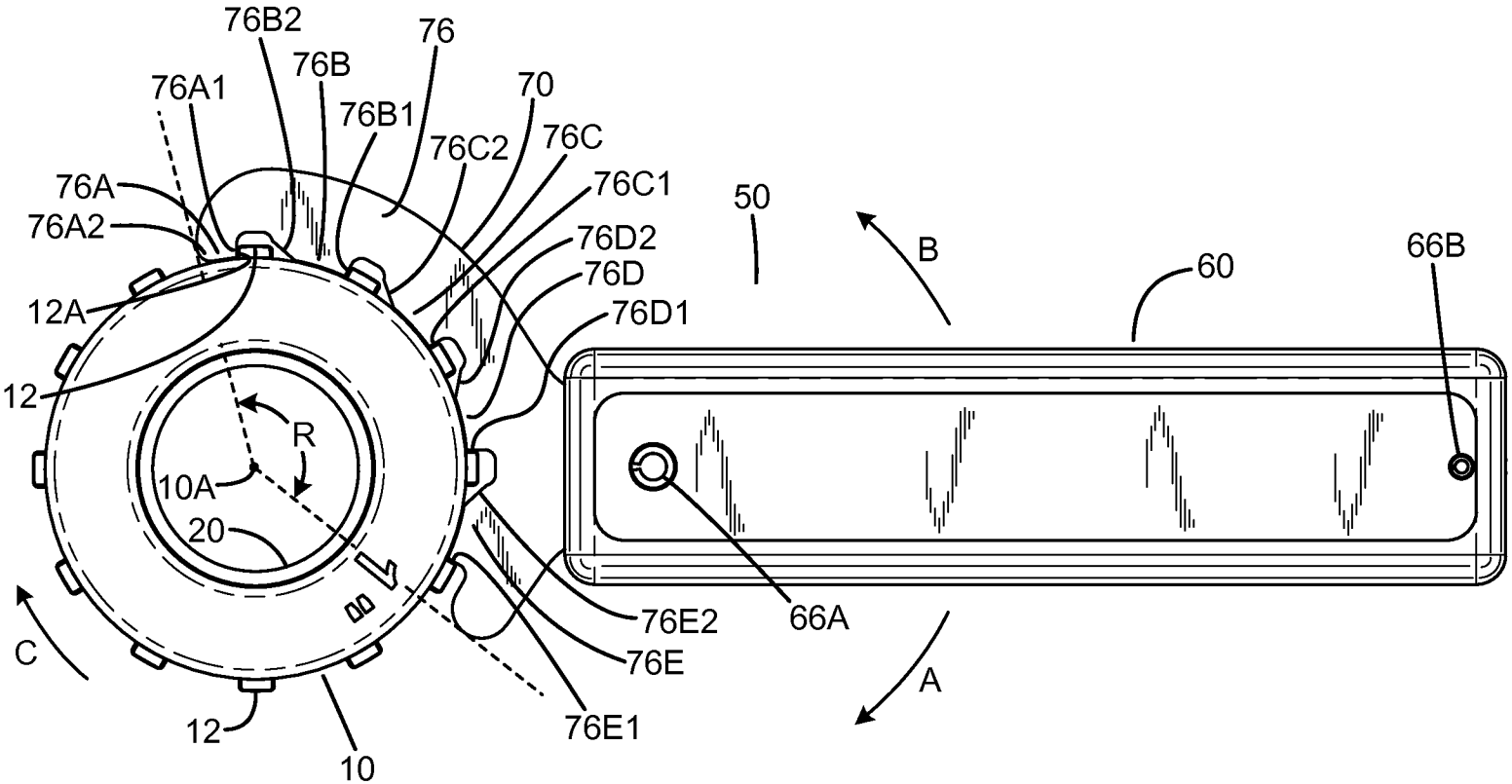
FIG. 4C is a top view of the arrangement of FIG. 4B.

The torque wrench 50 in this exemplary embodiment is configured to engage a nut 10 having an external spline pattern of splines 12, separated by a spacing or pitch distance D (FIG. 4A). FIGS. 4B and 4C illustrate the torque limiting wrench 50 in engaged position on the nut 10. The nut 10 is part of a plastic tube connection or joint, which connects a plastic tube 20 having a flared end 20 to a male fitting 30 with external threads 32. The internal threads of the nut 10 engage the external threads of the male fitting, and as the nut is tightened to the fitting, the flared end 22 is brought into tightened engagement with the male fitting 30. The wrench 50 is used to apply tightening force, in the clockwise direction of arrow A (FIGS. 4B, 4C), until the pre-set torque limit has been reached. At that time, the force tending to rotate the jaw about the pivot pin will overcome the force applied by the mechanism including the post 80, spring 82 and screw 84 to the jaw tending to prevent rotation of the jaw. The jaw 70 will then pivot on pin 66A from the position shown in FIG. 2A to the position shown in FIG. 2B. The user will feel the jaw position "break" from its original, tightening position as the post 80 is pushed down and out of engagement with the detent in the jaw. This will indicate that the pre-set torque limit has been achieved, and the nut tightened to the desired torque. In this manner, the leak performance of the joint between the plastic tube 20 and the male fitting 30 is enhanced by the application of the proper torque to the joint.

One feature of the exemplary embodiment of the torque wrench 50 is that the circumferential extent of the teeth of the jaw 70 about the nut 10 is less that one half the circumference of the nut. This relatively short "bite" of the wrench jaw allows the jaw 70 to be engaged to the nut by movement transverse to the axis of the nut, e.g. by a radial movement with some movement in the direction of arrow A if necessary. It is not necessary to align the wrench jaw axially with respect to the end of the nut and then move the wrench axially into engagement with the nut and splines, as is the case with other wrenches. This feature allows the wrench to be used in tight quarters, and situations in which the nut cannot be accessed from above or below the nut to bring a conventional wrench into engagement.

In an exemplary embodiment, the teeth of the jaw may be configured in cooperation with the spline pattern on the nut size for which it is designed. Fitting nuts are typically available for various sizes of tubing, for example, ¼, ⅜, ½, ¾ and 1 inch diameters. FIGS. 4A-4C illustrate an exemplary "1 inch" nut, i.e. a nut configured for use with tubing having a 1 inch outer diameter, and the exemplary torque wrench 50 is designed with a jaw opening size and teeth pattern to match the exemplary nut size and spline pattern. The nut 10 in this example has an outer diameter of 1.90 inch, and twelve splines extend longitudinally along the outer periphery of the nut in an evenly spaced arrangement, at 30 degree nominal spacing, and parallel to the center axis of the nut. In this exemplary embodiment, each spline is 0.15 inch wide and has a height (extending above the peripheral surface of the nut) of 0.06 inch, although these dimensions may vary depending on the nut size and the particular application. The nut 10 in this embodiment is a unitary molded structure, fabricated from a plastic material, e.g. PFA or PVDF.

Still referring to FIGS. 4A-4C, the jaw 70 of the torque wrench 50 in this embodiment has a plurality, five in this case, jaw teeth 76A, 76B, 76C, 76D and 76E, which are supported by a curved jaw arm portion 76, and configured to engage five adjacent splines 12 on the nut 10, i.e. less than half the splines spaced about the nut periphery. The plurality of spaced teeth supported on a curved configuration and have a circumferential extent of less than one half the entire circumference of the nut to be tightened. When placed in engagement on the nut, the circumferential reach or extent R of the jaw 70 is less than 180 degrees, as indicated in FIG. 4C. Each tooth has a spline engaging edge (76A1, 76B1, 76C1, 76D1, 76E1) surface which will be at least parallel to the spline edge to provide direct contact with the spline vertical surface 12A (i.e. the surface extending generally radially or perpendicular to the nut peripheral surface. In other embodiments the spline engaging edge surface may be inclined to form a sawtooth-like tooth surface to increase the sharpness of the tooth tip engaging against the spline surface or nut peripheral surface. As the torque wrench is rotated about the axis 10A of the nut 10, in the direction indicated by arrow A in FIG. 4C, the nut is rotated in the direction of arrow C.

Each tooth of the jaw 70 further has a inclined or rounded tooth surface (76A2, 76B2, 76C2, 76D2, 76E2) on the opposite edge of the tooth from the spline engaging edge, to facilitate sliding over the splines when the torque wrench is rotated in the direction of arrow B (FIG. 4C) in a ratchet-like fashion without turning the nut in the opposite direction to arrow C. The tooth edge 76A2 is rounded to minimize the size of the tip of the jaw; tooth edges 76B2, 76C2, 76C2, 76D2, 76E2 are inclined to slide over the adjacent splines when the wrench is rotated in the direction C so as not to apply sufficient force to rotate the nut in the loosen direction.

The wrench can be used to take successive "bites" on the nut to incrementally tighten the nut 10 onto its fitting 30 (FIG. 4B), by first rotating the wrench handle in the direction A to rotate the nut through whatever range of movement is available or convenient, ratchet the wrench handle in direction B to reposition the jaw on the nut in a successive position without loosening the nut, and then rotate again in direction A to continue to tighten the nut. Once the nut is tightened to require application of torque which exceeds the pre-set torque limit of the wrench, the jaw 70 will move from the tightening position (FIG. 2A) to the tightened position (FIG. 2B), indicating that the nut has been tightened to the pre-set torque, and the tightening procedure on that nut is completed. The pre-set torque limit will be dependent on the particular fitting application; typical nominal torque limits for PFA fittings are in the range of 5 to 55 in-lbs.

Figure 5A:
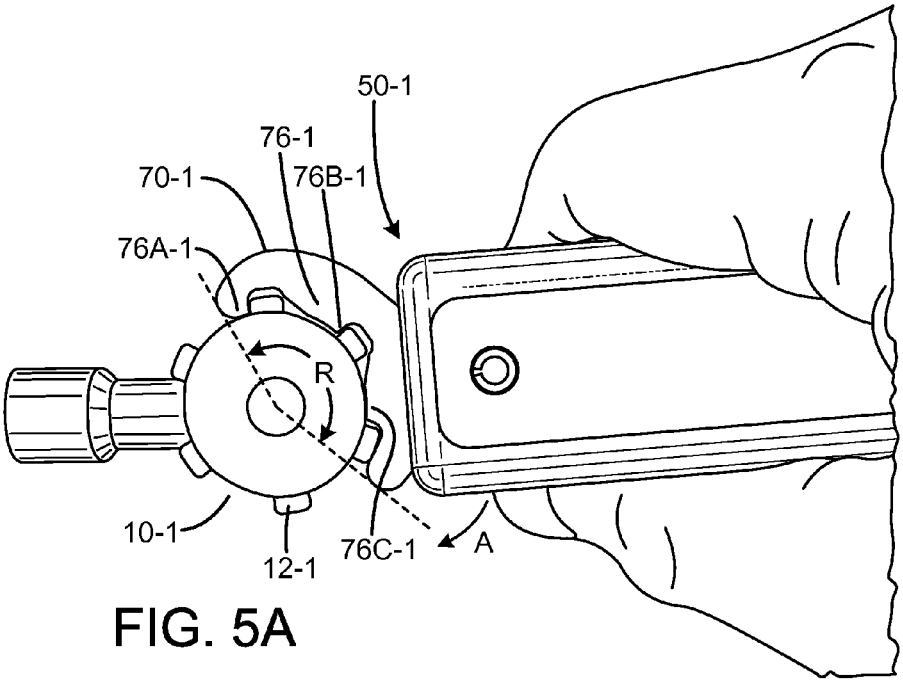
Figure 5B:
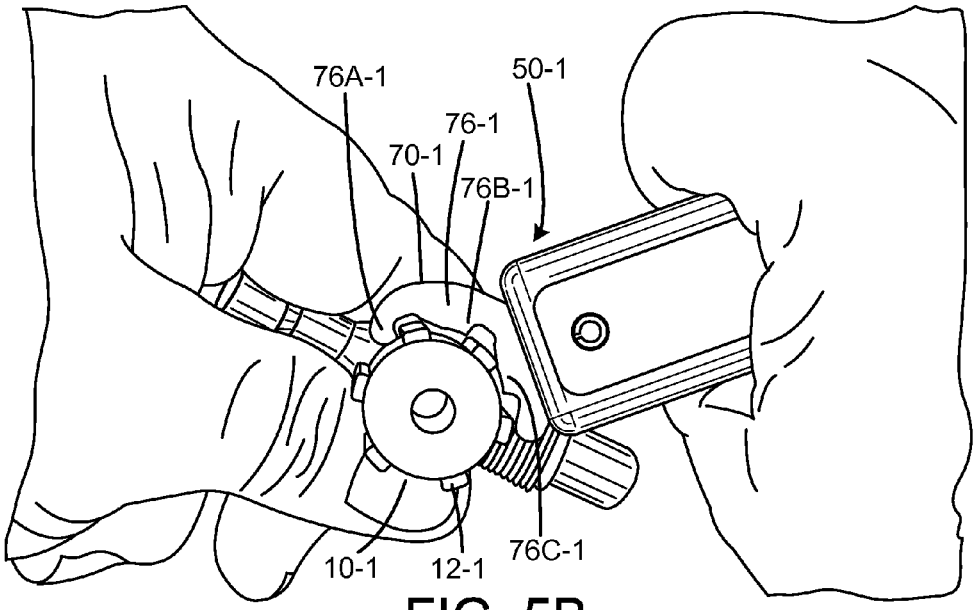

FIGS. 5A-5C diagrammatically illustrate use of another embodiment of a torque wrench 50-1 on a nut 10-1 and fitting. The torque wrench 50-1 is configured to engage on splines of a nut nominally rated for ¼ inch applications, i.e. for use with tubing having a ¼ outer diameter. The nut 10-1 has six splines 12-1 equally spaced around the periphery of the nut. The jaw 70-1 of the wrench 50-1 in this embodiment has three teeth, 76A-1, 76B-1 and 76C-1, which are configured to engage with three contiguous splines on the nut 10-1. When placed in engagement on the nut, the circumferential reach R of the jaw 70-1 is less than 180 degrees, as indicated in FIG. 5A. FIG. 5A shows the wrench in a tightening condition. FIG. 5B illustrates the wrench in a ratcheting condition, moving from one "bite" on the nut to the next. FIG. 5C illustrates the wrench and nut in the condition that the pre-set torque limit has been applied and the jaw has "broken" from the tightening position (as in FIG. 2A) to the fully tightened condition (as in FIG. 2B). FIGS. 6A and 6B show the torque wrench 50-1 and jaw 70-1 in the tightening position (as in FIG. 2A), and fully tightened position (as in FIG. 2B), respectively.

Figure 7A:
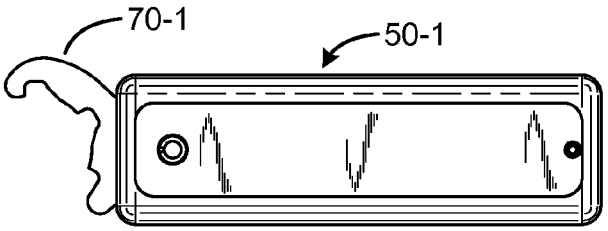
FIG. 7A-7E illustrate respective torque wrenches configured to individually fit five different nut sizes.
Figure 7B:
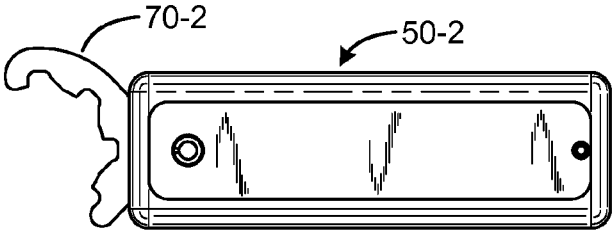
Figure 7C:
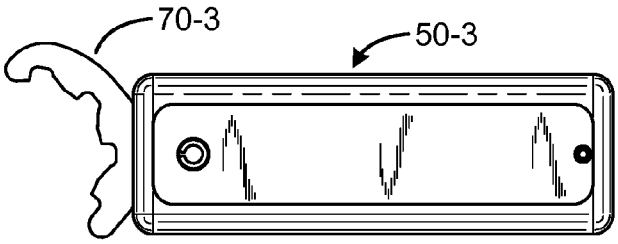
Figure 7D:
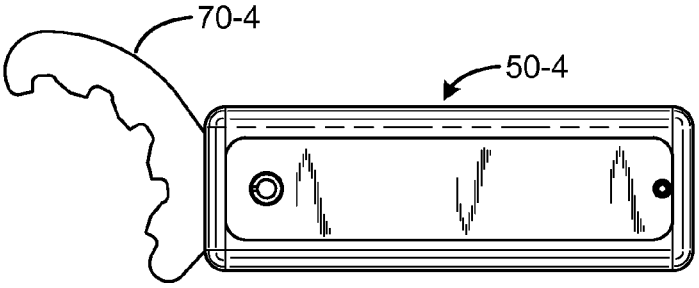
Figure 7E:
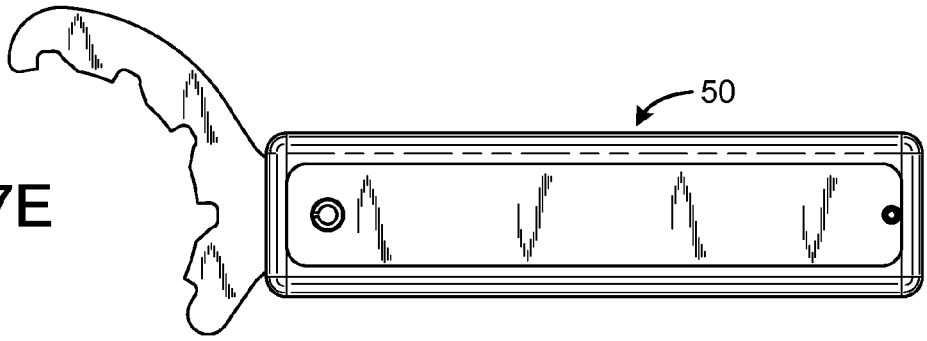
Figure 8A:
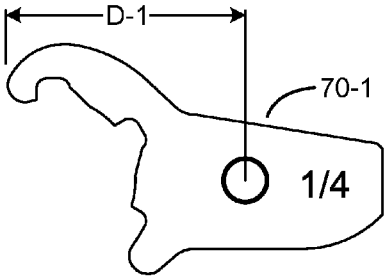
FIGS. 8A-8E illustrate the torque wrench jaw for each of the set of torque wrenches of FIG. 7.
Figure 8B:
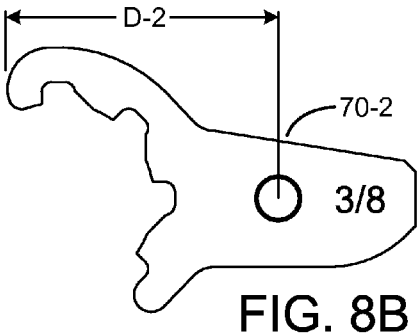
Figure 8C:
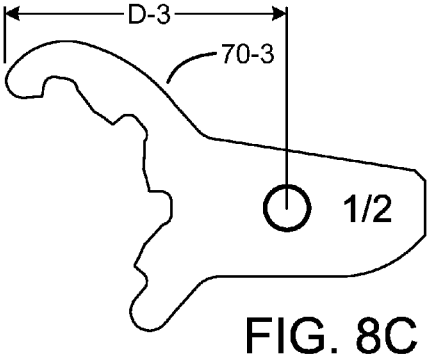
Figure 8D:
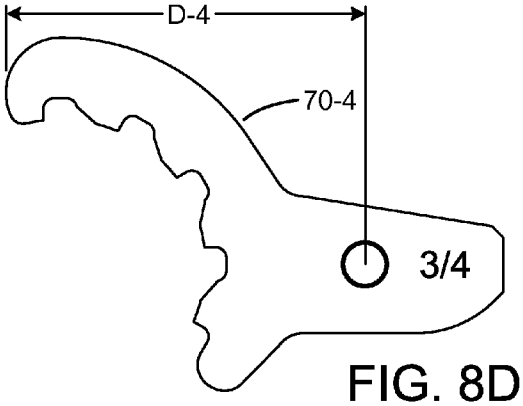
Figure 8E:
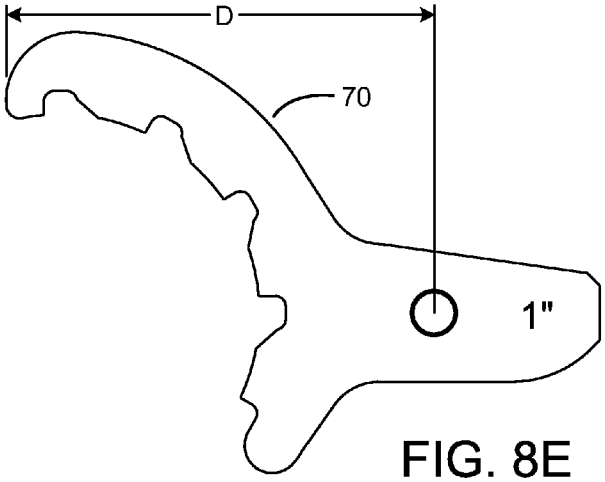

FIGS. 7A-7E illustrate five different torque wrench sizes, each configured to engage a correspondingly sized and configured nut. FIG. 7A depicts wrench 50-1 with jaw 70-1, as described above, for the ¼ inch nut fitting. FIGS. 7B-7D respectively depict wrenches 50-2 with jaw 70-2, 50-3 with jaw 50-3, 50-4 with jaw 70-4, for respective ⅜, ½ and ¾ inch nut sizing, in which the dimension refers to the outer diameter of the tubing with which the nut is to be used. FIG. 7E depicts wrench 50 as described above for a 1 inch nut size. For these exemplary cases, the corresponding outer diameters of the nuts are as follows:

¼"=0.84 OD of Nut
⅜"=0.96 OD of Nut
½"=1.08 OD of Nut
¾"=1.41 OD of Nut
1"=1.90 OD of Nut

Exemplary dimensions for the handles of the wrenches illustrated in FIGS. 7A-7D are 3 inches long, by 1 inch high and 0.625 inch thick. An exemplary set of dimensions for the handle of the wrench 50 in FIG. 7E are 4 inches long by 1 inch high by 0.625 inches thick. With these dimensions, the wrench handles are palm-sized, i.e. readily graspable within the user's palm.

FIGS. 8A-8E show the respective jaws 70-1, 70-2, 70-3, 70-4 and 70 for the respective torque wrenches shown in FIGS. 7A-7E in front view. For the exemplary wrench embodiments illustrated in FIGS. 7A-7D, the handle is identical for all four wrenches. The jaw is tailored to the specific nut size. The jaw structures 70-1, 70-2, 70-3, 70-4 and 70 may be packaged and sold separately, either as a set or individually, from the handle, and the same handle can be used with any of the jaws in FIGS. 8A-8D. The wrench may be a set of a single handle and multiple jaw structures, with the user assembling the desired jaw to the handle to meet a specific application. The user would typically calibrate the wrench after assembling the jaw to the handle, e.g. by setting the tongue of the jaw into the handle channel, inserting the pin 66A, iteratively adjusting the set screw 84 to adjust the torque limit and measuring the torque limit with a torque tester until the desired torque limit has been set.

The jaws 70-1 to 70-4 and 70 are sized appropriately to match the corresponding nut size. For the indicated nut size in FIGS. 8A-8E, the jaws have a dimension (D-1, D-2 . . . D) from the pivot opening to the jaw tip as indicated below:

D-1=1.02 inch
D-2=1.12 inch
D-3=1.13 inch
D-4=1.52 inch
D=1.97 inch

These dimensions are for a specific application; for other applications, jaws with different dimensions may be utilized.

Although the foregoing has been a description and illustration of specific embodiments of the invention, various modifications and changes thereto can be made by persons skilled in the art without departing from the scope and spirit of the invention.

What is claimed is:

1. A torque limiting wrench for tightening threaded splined or grooved nuts on a threaded male fitting, the threaded nuts having a circumference dimension, the wrench comprising:

a handle structure;

a rigid jaw structure comprising a curved jaw arm portion and a tongue portion, the jaw structure pivotably connected to the handle for movement about a pivot point between a tightening position of the tongue portion relative to the handle structure and a fully tightened position of the tongue portion relative to the handle structure, the pivot point disposed between a tip of the tongue portion and the jaw arm portion;

a mechanism carried by the handle structure, the mechanism configured to apply a force to hold the jaw structure in the tightening position until the amount of torque applied to the pivot connection between the jaw structure and handle exceeds a pre-determined limit, and then allows the jaw to pivot to the fully tightened position, wherein the mechanism includes a sliding engaging member pushed into engagement with the jaw tongue portion by a spring element applying a bias force to determine the torque limit;

the jaw structure including a plurality of spaced teeth supported on the curved jaw arm portion, the curved jaw arm portion having a circumferential extent so dimensioned as to be less than one half the circumference dimension of the nut to be tightened, so that the jaw structure can be engaged to the nut without requiring an axial movement from a first end of the nut toward a second end of the nut; and wherein the plurality of spaced teeth includes a set of teeth, each having first and second opposed surfaces, wherein each of the first surfaces is configured to engage against spline or groove surfaces on the nut as the wrench is being rotated in a first direction to tighten the nut on the fitting, and each of the second opposed surfaces is inclined or rounded to facilitate sliding the jaw arm structure over spline or groove surfaces without turning the nut when the wrench is being rotated in a second direction opposite the first direction;

wherein the jaw structure is so configured that clearance spaces are defined between the jaw structure and top-most surfaces of engaged splines or grooves with the jaw structure in the tightening position; and wherein each of the clearance spaces is defined by the first surface of one of the plurality of spaced teeth that engages against spline or groove surfaces and the second inclined or rounded surface of an adjacent tooth of the plurality of teeth connected to said first surface by an interconnecting surface therebetween.

2. The wrench of claim 1, wherein each of said first surfaces of said set of teeth is configured to extend in parallel alignment with a spline or groove surface projecting perpendicularly from an outer peripheral surface of the nut.

3. The wrench of claim 1, wherein the jaw tongue portion includes a detent, and the sliding engaging member is received in the detent with the jaw structure in the tightening position.

4. The wrench of claim 1, wherein the mechanism further includes a threaded member for positioning an end of the spring element toward or away from the jaw tongue portion to adjust the amount of bias force applied to the sliding engaging member and the pre-set torque limit, and a locking member to lock the position of the threaded member.

5. The wrench of claim 1, wherein the handle is palm-sized, with a length in a range between about three to four inches.

6. The wrench of claim 1, wherein the handle structure has a channel defined in a first end, and the jaw tongue portion is received into the channel.

7. The wrench of claim 6, further comprising a pivot pin extending through the channel and through a pivot opening in the jaw structure to form the pivot connection.

8. The wrench of claim 1, wherein the plurality of spaced teeth are configured to engage adjacent ones of the spline or groove surfaces on the nut.

9. The wrench of claim 1, wherein the plurality of spaced teeth are configured to engage adjacent ones of the spline or groove surfaces on the external periphery of the nut.

10. The wrench of claim 9, wherein the number of spaced teeth is three.

11. The wrench of claim 9, wherein the number of spaced teeth is five.

12. A torque limiting wrench system, comprising:

a threaded nut having a splined or grooved external peripheral surface with a circumference dimension;

a torque limiting wrench for tightening the threaded nut on a threaded fitting, the wrench comprising:

a handle structure;

a rigid jaw structure separate from the handle structure and comprising a curved jaw arm portion and a tongue portion, the jaw structure pivotably connected to the handle structure for movement about a pivot point between a tightening position of the tongue portion relative to the handle and a fully tightened position of the tongue portion relative to the handle, the pivot point disposed between a tip of the tongue portion and the jaw arm portion;

a mechanism carried by the handle structure, the mechanism configured to apply a force to hold the tongue portion in the tightening position until the amount of torque applied to the pivot connection between the jaw structure and handle exceeds a pre-determined limit, and then allows the tongue portion to move to the fully tightened position, wherein the mechanism includes a sliding engaging member pushed into engagement with the tip of the jaw tongue portion by a spring element applying a bias force to determine the torque limit;

the jaw structure including a plurality of spaced teeth supported on the curved jaw arm portion, the curved jaw arm having a circumferential extent so dimensioned as to be less than one half the circumference dimension of the nut, so that the jaw structure can be engaged to the nut without requiring an axial movement from a first end of the nut toward a second end of the nut; and wherein the plurality of spaced teeth includes a set of teeth, each having first and second opposed surfaces, wherein each of the first surfaces is configured to engage against spline or groove surfaces on the external peripheral surface of the nut as the wrench is being rotated in a first direction to tighten the nut on the fitting, and each of the second opposed surfaces is inclined or rounded to facilitate sliding the jaw arm structure over the spline or groove surfaces without turning the nut when the wrench is being rotated in a second direction opposite the first direction;

wherein the jaw structure is so configured that clearance spaces are defined between the jaw structure and top-most surfaces of engaged splines or grooves with the jaw structure in the tightening position; and wherein each of the clearance spaces is defined by the first surface of one of the plurality of spaced teeth that engages against spline or groove surfaces and the second inclined or rounded surface of an adjacent tooth of the plurality of teeth connected to said first surface by an interconnecting surface.

13. The wrench system of claim 12, wherein the nut is a PVDF or PFA nut for engage threads on the fitting to draw a flared plastic tubing end into engagement with the male fitting to enhance leak performance of the joint between the plastic tubing and the male fitting.

14. The wrench system of claim 12, wherein each of said first surfaces of said set of teeth is configured to extend in parallel alignment with a spline or groove surface projecting perpendicularly from the external peripheral surface of the nut.

15. The wrench system of claim 12, wherein the jaw tongue portion includes a detent, and the sliding engaging member is received in the detent with the jaw structure in the tightening position.

16. The wrench system of claim 12, wherein the mechanism further includes a threaded member for positioning an end of the spring element toward or away from the jaw tongue portion to adjust the amount of bias force applied to the sliding engaging member, and a locking member to lock the position of the threaded member.

17. The wrench system of claim 12, wherein the plurality of spaced teeth are configured to engage adjacent ones of the spline or groove surfaces on the external periphery of the nut.

18. The wrench system of claim 17, wherein the number of spaced teeth is three.

19. The wrench system of claim 17, wherein the number of spaced teeth is five.

* * * * *